US006903307B1

(12) United States Patent
McConnell et al.

(10) Patent No.: US 6,903,307 B1
(45) Date of Patent: Jun. 7, 2005

(54) HYGIENIC WIPES STEAMER

(75) Inventors: Thomas E. McConnell, Santa Ynez, CA (US); Francois P. Hacquard, Los Angeles, CA (US); Joseph Merchant, Lake Forest, CA (US); Timothy Payne, Santa Ana, CA (US); Earl Robinson, Lake Forest, CA (US); Andrew Scherer, Trabuco Canyon, CA (US)

(73) Assignee: Prince Lionheart, Inc., Santa Maria, CA (US)

( * ) Notice: Subject to any disclaimer, the term of this patent is extended or adjusted under 35 U.S.C. 154(b) by 0 days.

(21) Appl. No.: 10/958,030

(22) Filed: Oct. 4, 2004

(51) Int. Cl.[7] ..... A47K 10/38; A47K 7/00

(52) U.S. Cl. ..... 219/401; 219/214; 219/385; 222/146.4; 222/146.5; 221/150 A

(58) Field of Search ..... 219/385, 386, 219/214, 401; 222/146.4, 146.5; 221/150 A

(56) References Cited

U.S. PATENT DOCUMENTS

| | | | |
|---|---|---|---|
| 1,307,542 | A | 6/1919 | Elder |
| 1,659,185 | A | 2/1928 | Baker |
| 2,004,614 | A | 6/1935 | Meagher |
| 2,044,284 | A | 6/1936 | Dargavel |
| 2,443,321 | A | 6/1948 | Miner, Jr. |
| 2,733,709 | A | 2/1956 | Sukacev |
| 2,805,591 | A | 9/1957 | Appleton |
| 2,840,266 | A | 6/1958 | Nelson |
| 2,854,134 | A | 9/1958 | Humphrey |
| 2,990,948 | A | 7/1961 | Zackheim |
| 3,084,664 | A | 4/1963 | Perlman et al. |
| 3,264,188 | A | 8/1966 | Gresham |
| 3,269,593 | A | 8/1966 | Lodewick et al. |
| 3,343,716 | A | 9/1967 | Peebles |
| 3,368,522 | A | 2/1968 | Cordis |
| 3,369,698 | A | 2/1968 | Scholz |
| 3,383,012 | A | 5/1968 | Adell |
| 3,568,635 | A | 3/1971 | Poitras et al. |
| 3,592,161 | A | 7/1971 | Hoffmann |
| 3,626,152 | A | 12/1971 | Governale et al. |
| 3,683,889 | A | 8/1972 | Hoffman |
| 3,726,395 | A | 4/1973 | Duhy |
| 3,775,801 | A | 12/1973 | Walker |
| 3,780,908 | A | 12/1973 | Fitzpatrick et al. |
| 3,784,055 | A | 1/1974 | Anderson |
| 3,843,017 | A | 10/1974 | Harrison |
| 3,849,629 | A | 11/1974 | Graham, Jr. |

(Continued)

FOREIGN PATENT DOCUMENTS

| | | |
|---|---|---|
| CA | 2176623 | 11/1997 |
| JP | 8-24157 | 1/1996 |
| JP | 11-155755 | 6/1999 |
| JP | 2000-93341 | 4/2000 |
| JP | 2003232500 A * | 8/2003 |

*Primary Examiner*—Joseph Pelham
(74) *Attorney, Agent, or Firm*—Stetina Brunda Garred & Brucker

(57) ABSTRACT

Provided is a hygienic wipes steamer for warming hygienic wipes. The hygienic wipes steamer comprises a housing assembly contains a liquid container, a roller assembly, a heater assembly and an ejector assembly. The liquid container stores a quantity of liquid. The roller assembly rotatably supports a roll of material and cuts the material into individual hygienic wipes during unwinding of the material. The heater assembly has a beating element and has steam holes formed therealong. The heater assembly is in fluid communication with the liquid container and receives hygienic wipes from the roller assembly. Upon activation of the hygienic wipes steamer, liquid flows into the heater assembly from the liquid container and is transformed into steam when heated by the heating element such that the steam passes through the steam holes and warms the hygienic wipe that is supported by the heater assembly. The ejector assembly ejects the warmed hygienic wipes from the hygienic wipes steamer.

23 Claims, 5 Drawing Sheets

U.S. PATENT DOCUMENTS

| | | | | | |
|---|---|---|---|---|---|
| 3,862,616 | A | | 1/1975 | Brady | |
| 3,865,271 | A | | 2/1975 | Gold | |
| 3,868,052 | A | | 2/1975 | Rockefeller | |
| 3,902,044 | A | | 8/1975 | Doyle et al. | |
| 3,947,134 | A | | 3/1976 | Ogawa | |
| 3,986,479 | A | | 10/1976 | Bonk | |
| 4,017,002 | A | | 4/1977 | Doyle et al. | |
| 4,084,080 | A | | 4/1978 | McMahan | |
| 4,117,309 | A | | 9/1978 | Cayley | |
| 4,163,896 | A | | 8/1979 | McAvinn et al. | |
| 4,180,160 | A | | 12/1979 | Ogawa et al. | |
| 4,289,253 | A | | 9/1981 | Andersson | |
| 4,495,402 | A | | 1/1985 | Burdick et al. | |
| 4,694,973 | A | | 9/1987 | Rose et al. | |
| 4,700,048 | A | | 10/1987 | Levy | |
| 4,762,113 | A | | 8/1988 | Hamasaki | |
| 4,810,859 | A | | 3/1989 | Anabtawi et al. | |
| 4,943,705 | A | | 7/1990 | Halloran | |
| 4,947,026 | A | | 8/1990 | Groom et al. | |
| 5,210,396 | A | | 5/1993 | Sanders | |
| D343,732 | S | | 2/1994 | McConnell | |
| 5,680,810 | A | | 10/1997 | Sham | |
| 5,697,577 | A | * | 12/1997 | Ogden | 242/598.6 |
| 5,738,082 | A | | 4/1998 | Page et al. | |
| 5,802,963 | A | | 9/1998 | Cohn et al. | |
| 5,869,812 | A | | 2/1999 | Creamer et al. | |
| 6,018,145 | A | | 1/2000 | Moreno | |
| 6,179,162 | B1 | * | 1/2001 | Motsenbocker | 221/150 A |
| 6,392,200 | B1 | * | 5/2002 | Nakamura et al. | 219/386 |
| 6,476,365 | B1 | * | 11/2002 | Rios | 219/521 |
| 6,610,966 | B2 | * | 8/2003 | Julius | 219/386 |
| 6,639,185 | B1 | | 10/2003 | McConnell et al. | |
| 6,667,464 | B2 | | 12/2003 | Ellis | |
| 6,674,048 | B2 | | 1/2004 | McConnell et al. | |

* cited by examiner

HYGIENIC WIPES STEAMER

CROSS-REFERENCE TO RELATED APPLICATIONS (Not Applicable)

STATEMENT RE: FEDERALLY SPONSORED RESEARCH/DEVELOPMENT (Not Applicable)

BACKGROUND OF THE INVENTION

The present invention relates generally to hygienic wipes warmers, and more particularly to an improved hygienic wipes steamer that is specifically adapted to produce individual, warmed and moistened hygienic wipes from a roll of uncut, dry non-woven or paper material.

Hygienic wipes have been marketed in the United States for many years. Essentially, hygienic wipes are small pre-moistened paper or synthetic (non-woven) towelettes and are typically available in packages to the consuming public. They are used to cleanse the skin of infants and small children and are also referred to as baby wipes. The wipe fluid content for these pre-moistened wipes is generally comprised of cleansers, lotions and preservatives.

A few years after the hygienic wipes were introduced into the marketplace, various products for warming the wipes were made available to the public. Such products have been devised to comfort the hygienic wipe users from the inherent "chill" given off by the contact of the moistened wipes. For example, it is now a common practice for parents to employ the use of warm hygienic wipes (i.e., hygienic wipes) on their children.

These warming products are generally electric operated and come in two distinct styles. One is an "electric blanket" style which is sized to wrap around the external surfaces of a plastic hygienic wipes container. The other is a self-contained plastic "appliance" style which warms the accommodated hygienic wipes with its internally positioned heating element. Though such currently known and available hygienic wipes warming products achieve their primary objective of warming hygienic wipes, they possess certain deficiencies which detract from their overall utility.

One significant deficiency of the prior art hygienic wipes warmers is their inability to quickly and thoroughly warm the hygienic wipes. The prior art hygienic wipes warmers are typically configured to position a heating element in general proximity to an area where the hygienic wipes are disposed. In this respect, the generated heat is merely conveyed to such area which then gradually and slowly diffuses itself therethroughout so that the hygienic wipes can eventually be heated to the elevated temperature. However, even then, not all the hygienic wipes are adequately warmed as the heat often times does not reach the hygienic wipes disposed in the middle of a hygienic wipes stack. As such, the prior art hygienic wipes warmers expend a great amount of time in warming up the hygienic wipes, often with inadequate performance.

Another deficiency of the prior art hygienic wipes warming products is the inability to sustain the coloration of the hygienic wipes. More specifically, in prior art hygienic wipes warming products, discoloration or browning of the hygienic wipes occurs because of a reaction of various chemicals in the wipes to heating. As such, even though the prior art hygienic wipes warming products may adequately warm the hygienic wipes, they cannot, however, avoid the undesirable effects of discoloration when warming them. In addition, prior art hygienic wipes warming products are limited in the temperature to which they can effectively heat the hygienic wipes because of browning and drying out of the hygienic wipes that occurs over time. Even further, prior art hygienic wipes warming products are by their nature often ineffective in heating the hygienic wipes to a sufficiently elevated temperature. More particularly, the heated hygienic wipes may only be heated up to body temperature due to rapid dissipation of heat when the hygienic wipes are exposed to open air.

An even further deficiency associated with prior art hygienic wipes warming products is the requirement that the hygienic wipes must be provided in a stacked formation. In addition, each one of the hygienic wipes in the stack must be pre-cut to a size that is compatible with the particular hygienic wipes warming device. Furthermore, the pre-cut hygienic wipes must be layered in registration with one another (i.e., aligned) and/or pre-folded in the stack formation such that the stack will fit within the hygienic wipes warmer.

After heating, the individual hygienic wipes may then be withdrawn from the hygienic wipe warming device and/or unfolded for use. As may be appreciated, the necessity of precutting, pre-folding, and layering in registration the hygienic wipes increases the manufacturing costs associated with hygienic wipes. Such costs are ultimately passed on to the consumer during the initial purchase of hygienic wipes and for subsequent refill purchases. In addition, the warm, moist, dark environment within some prior art hygienic wipes warming products provides an unhealthy breeding ground for potentially harmful micro-organisms (e.g., germs).

Some prior art hygienic wipes warmers present another deficiency in the form of a safety hazard due to the inclusion of a hot water container within the hygienic wipes warmer. Such prior art hygienic wipes warmers operate by heating the container of water and then using steam from the heated water to warm a hygienic wipe. While such a hygienic wipes warmer may be acceptable for use in certain commercial or institutional environments, the hot water in the container may pose an unreasonable risk in a home environment. For example, it is foreseeable that a toddler could pull the hygienic wipes warmer off of a countertop or a table with resulting scalding of the toddler by the hot water in the container.

Prior art hygienic wipes warmers of the type having the heated water container are additionally inconvenient from a time efficiency standpoint. Such hygienic wipes warmers require a relatively lengthy waiting period (e.g., up to 30 minutes) from activation of the hygienic wipes warmer until a warmed hygienic wipe is produced. This is because the entire contents of the water container must be sufficiently heated in order to then heat the hygienic wipes to an acceptable temperature. Such lengthy waiting period may be unacceptable and impractical in certain situations such as those situations involving infant care.

Thus, there exists a substantial need in the art, and in the infant products manufacturing business in particular, for a hygienic wipes warming product that can effectively provide warmth to the hygienic wipes without discoloring them. Additionally, there exists a need in the art for a hygienic wipes warming product that can heat the hygienic wipes in a time-efficient manner. Furthermore, there exists a need in the art for a hygienic wipes warming product that does not require the use of pre-cut, pre-folded, and layered hygienic wipes.

Additionally, there exists a need in the art for a hygienic wipes warming product that avoids the safety hazards associated with hot water containers as used in prior art hygienic wipes warmers. Also, there exists a need in the art for a hygienic wipes warming product that avoids the deficiencies associated with growth of micro-organisms in prior art prior art hygienic wipes warmers that use pre-moistened wipes. Finally, there exists a need in the art for a hygienic wipes warming product that can achieve these objectives in a user-friendly and cost-effective manner.

BRIEF SUMMARY OF THE INVENTION

Provided is a hygienic wipes steamer which is specifically adapted to produce individual, warmed and moistened hygienic wipes from a roll of uncut, dry non-woven or paper material. As used herein, the term "hygienic wipes" encompasses uses associated with baby wipes as well as uses associated with toilet hygiene and personal hygiene such as make-up removal and feminine care hygiene.

Advantageously, the hygienic wipes steamer of the present invention is configured to provide individual hygienic wipes within a relatively short period of time (e.g., ten to fifteen seconds) after activation of the hygienic wipes steamer. Additional hygienic wipes may be dispensed immediately upon activation of the hygienic wipes steamer or a pre-determined number of warmed hygienic wipes may be dispensed with a single activation, as will be described in greater detail below. The hygienic wipes steamer of the present invention avoids many of the safety hazards that are associated with the prior art hygienic wipes warmers in that the hygienic wipes steamer does not heat liquid contained within the liquid container, but rather flashes a small portion of liquid which is pumped from the liquid container into a heater assembly. Therefore, hazards of scalding, such as may occur should an infant pull the prior art hygienic wipes warmer off of a countertop or table, are avoided.

The hygienic wipes steamer of the present invention may also be configured to automatically shut off within a predetermined period of time after activation in order to avoid hazards of overheating. Furthermore, the hygienic wipes steamer of the present invention advantageously conducts heat into each of the individual hygienic wipes in an efficient manner as such hygienic wipes may be doubly wrapped or wound around a heater tube of the hygienic wipes steamer. The hygienic wipes steamer of the present invention may also be configured (i.e., programmed) to provide some measure of control over the temperature level to which the hygienic wipes may be heated. More specifically, the hygienic wipes steamer may include a means to delay ejection of the hygienic wipes for heating thereof to one of various heating levels (e.g., warm, medium hot and hot). In this manner, the efficiency and controllability of the hygienic wipes steamer in warming the hygienic wipes is improved as compared to prior art hygienic wipes warmers which operate by heating an entire stack of individual hygienic wipes.

The unique configuration of the hygienic wipes steamer of the present invention allows for the efficient conduction of heat into the hygienic wipes in a greater quantity and in a shorter period of time as compared to prior art hygienic wipes warmers. Finally, the hygienic wipes steamer of the present invention avoids discoloration, browning, drying and growth of micro-organisms that can occur in hygienic wipes as used in hygienic wipes warmers of the prior art. This is because in prior art hygienic wipes warmers, an entire stack of hygienic wipes must be heated even though only a few hygienic wipes may be used at a time. The unused hygienic wipes in the stack will eventually dry out and become discolored or browned as a result of the heat. In addition, such discoloration due to growth of micro-organisms may generate odors. Furthermore, the hygienic wipes steamer of the present invention does not necessarily use premoistened hygienic wipes that may otherwise encourage the growth of micro-organisms (i.e., germs). As will be appreciated, the hygienic wipes steamer of the present invention avoids the above described deficiencies by warming only a single hygienic wipe at a time.

In its broadest sense, the hygienic wipes steamer comprises a housing assembly, a liquid container, a roller assembly and a heater assembly all disposed within the housing assembly. An ejector assembly may be optionally included with the housing assembly for ejecting warmed and moistened hygienic wipes out of the steamer. The housing assembly is comprised of a housing body secured to a housing base. The housing body and housing base collectively define a housing compartment. The housing body may include a pair of opposed, spaced housing side walls and a pair of opposed, spaced housing end walls. A housing top wall may be joined to the housing side walls and to the housing end walls.

Access may be provided to the housing compartment by configuring the housing side walls and/or housing end walls to be at least partially removable, such as by pivoting. A removable base cover plate may be secured to an underside of the housing base to encapsulate the ejector assembly. An activation/indication mechanism may be disposed on an exterior of the base housing in order to allow a user to activate and operate the hygienic wipes steamer. In general, the hygienic wipes steamer may be operated by initially activating the activation/indication mechanism such that the heating element receives power for heating the heater assembly. Once the heating element is sufficiently heated, the activation/indication mechanism may provide the operator with an indication that the hygienic wipes steamer is ready for producing hygienic wipes. At this point, the roller assembly may be automatically or manually activated to start feeding the uncut material from the roll of material through the roller assembly and down to the heater assembly for steaming. After each individual hygienic wipe is steamed, the ejector assembly slides the warmed and moistened hygienic wipe off of the steamer assembly and out of the housing assembly.

The material roll may be mounted within the housing assembly at a lower portion thereof. Optionally, the material roll may be mounted within the housing assembly at an upper portion. The material roll is preferably mounted such that the material can be unwound and threaded toward the roller assembly. The liquid container is disposed within the housing assembly and is configured for storing a quantity of liquid. A fill port is included at an upper portion of the liquid container such that the liquid container may be filled and-refilled. Disposed at a lower end of the liquid container is a pump unit which is configured to pump liquid from the liquid container into the heater assembly. A fluid conduit connects the pump unit to the heater assembly. When the hygienic wipes steamer is activated and after the heating element is sufficiently warmed, the pump unit is then activated to pump liquid from the liquid container into the heater assembly, The roller assembly may be disposed in the housing assembly in an upward or downward portion thereof. The roller assembly may be disposed above or below the material roll in order to effectively receive a leading edge therefrom. The roller assembly comprises a roller motor and may include a cutting mechanism such as a pair of shear blades. The roller assembly is adapted to receive the leading edge of the material roll and successively partition the material into individual hygienic wipes. Optionally, the material roll may include spaced rows of preformed perforations extending across a width of the material for partioning the material into the individual hygienic wipes to eliminate the need for a cutting mechanism. Furthermore, the material may be wound onto the roll as individual hygienic wipes which are partitioned (i.e., separated) from one another upon unwinding from the material roll by the roller assembly which would also eliminate the need for the cutting mechanism.

However, if the cutting mechanism is included, the roller assembly is preferably configured to thread the material roll through the cutting mechanism. The cutting mechanism may be modular such that it can be readily removed and/or replaced by means of snap-in features provided with the housing assembly. The wipe support member guides the material roll over the top thereof and through the cutting mechanism. At least one feed roller is disposed so as to protrude at least partially outwardly from the wipe support member and are engageable with a pinch roller such that the leading edge of the material is captured between the pinch rollers and the feed roller to pull the leading edge of the material from the roll of material. The roller assembly includes the roller gear assembly which comprises a roller motor gear, a blade carrier gear and a feed roller gear. The blade carrier gear is sized such that the blade carrier rotates one revolution each time a hygienic wipe is cut from the roll of material.

Also included with the hygienic wipes steamer is a heater assembly. The heater assembly is configured to rotate about a longitudinal axis and to receive a hygienic wipe from the roller assembly. In its broadest sense, the heater assembly generally comprises a heater motor and a heater tube that is coupled to the heater motor. Like the cutting mechanism, the heater assembly may be modular such that it can be removed and/or replaced by various means such as snap-in features molded into the housing assembly. The heater tube is in fluid communication with the liquid container via the fluid conduit. At least one steam hole is formed through the heater tube. A heating element is disposed within the heater tube and is configured to provide a heat output to the heater assembly.

A fluid injection tube is disposed within the heater tube. The fluid injection tube is fluidly connected to the pump unit via the fluid conduit. Upon activation of the hygienic wipes steamer, the pump unit pumps fluid from the liquid container through the fluid conduit, through the fluid injection tube and into the heater tube. The heater motor causes the heater tube to rotate such that the hygienic wipe is wrapped about an exterior of the heater tube. Simultaneously, liquid flowing into the heater tube flashes upon contact with the heated environment. The flashing steam passes through the steam holes and irrigates the hygienic wipe. A clamping rod clamps the hygienic wipe to the heater tube upon take up from the roller assembly.

Following steaming and irrigation of the hygienic wipe, the clamping rod is unclamped from the heater tube and the ejector assembly slides the hygienic wipe off of the heater tube and ejects the hygienic wipe out of the housing assembly. The hygienic wipes steamer may be configured such that the roller motor, the heater motor, the pump unit and the ejector motor are operated in synchronization with one another. Such synchronization may be achieved through the use of processor circuitry (i.e., a microprocessor). Preferably the processor is operative to activate the ejector assembly such that rotation of the ejector motor, which is connected to the drive screw, causes axial movement of an ejector hook which is threadably engaged to the drive screw. The hook sleeve is preferably sized to fit over the heater tube and may be initially positioned so that it is butted up against the hygienic wipe. Therefore, activation of the ejector motor causes the hygienic wipe to be slid off of the heater tube and ejected out of the hygienic wipes steamer.

BRIEF DESCRIPTION OF THE DRAWINGS

These as well as other features of the present invention will become more apparent upon reference to the drawings wherein.

DETAILED DESCRIPTION OF THE INVENTION

Figure 1:
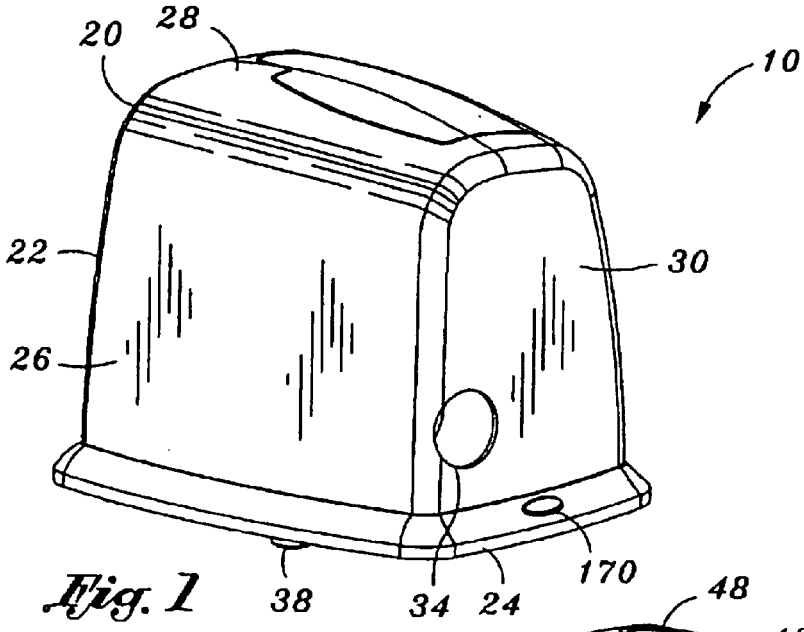
FIG. 1 is a perspective view of a hygienic wipes steamer in its fully assembled state.
Figure 2:
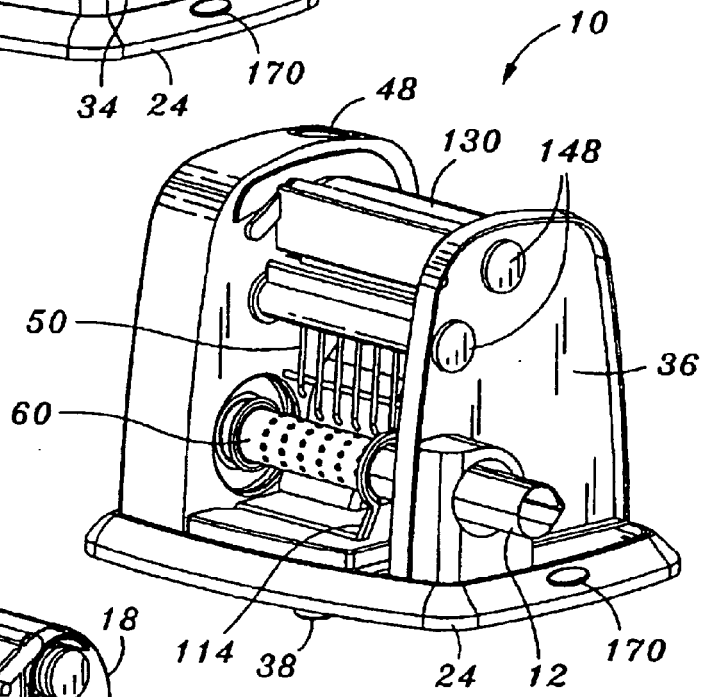
FIG. 2 is a perspective view of the hygienic wipes steamer having a housing assembly with portions removed in order to illustrate the ejection of a hygienic wipe out of the housing assembly.
Figure 3:
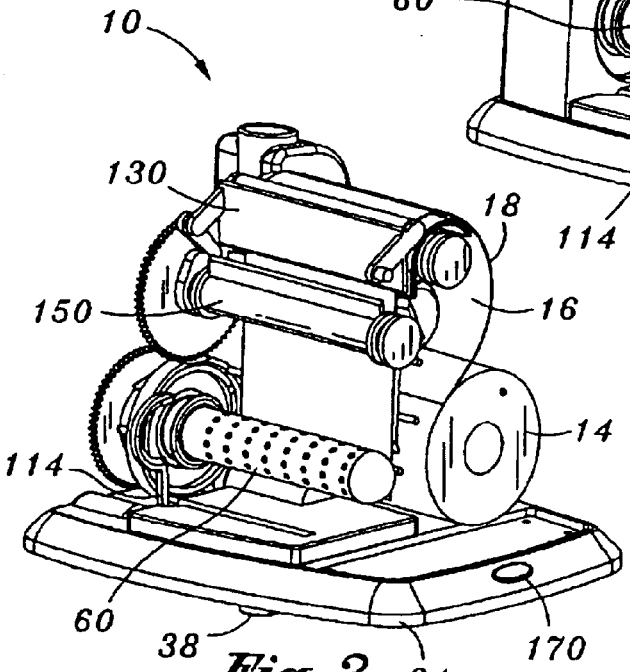
FIG. 3 is a perspective view of the hygienic wipes steamer having a housing body removed from a housing base to illustrate the mounting of a roll of material within the housing assembly.
Figure 4:
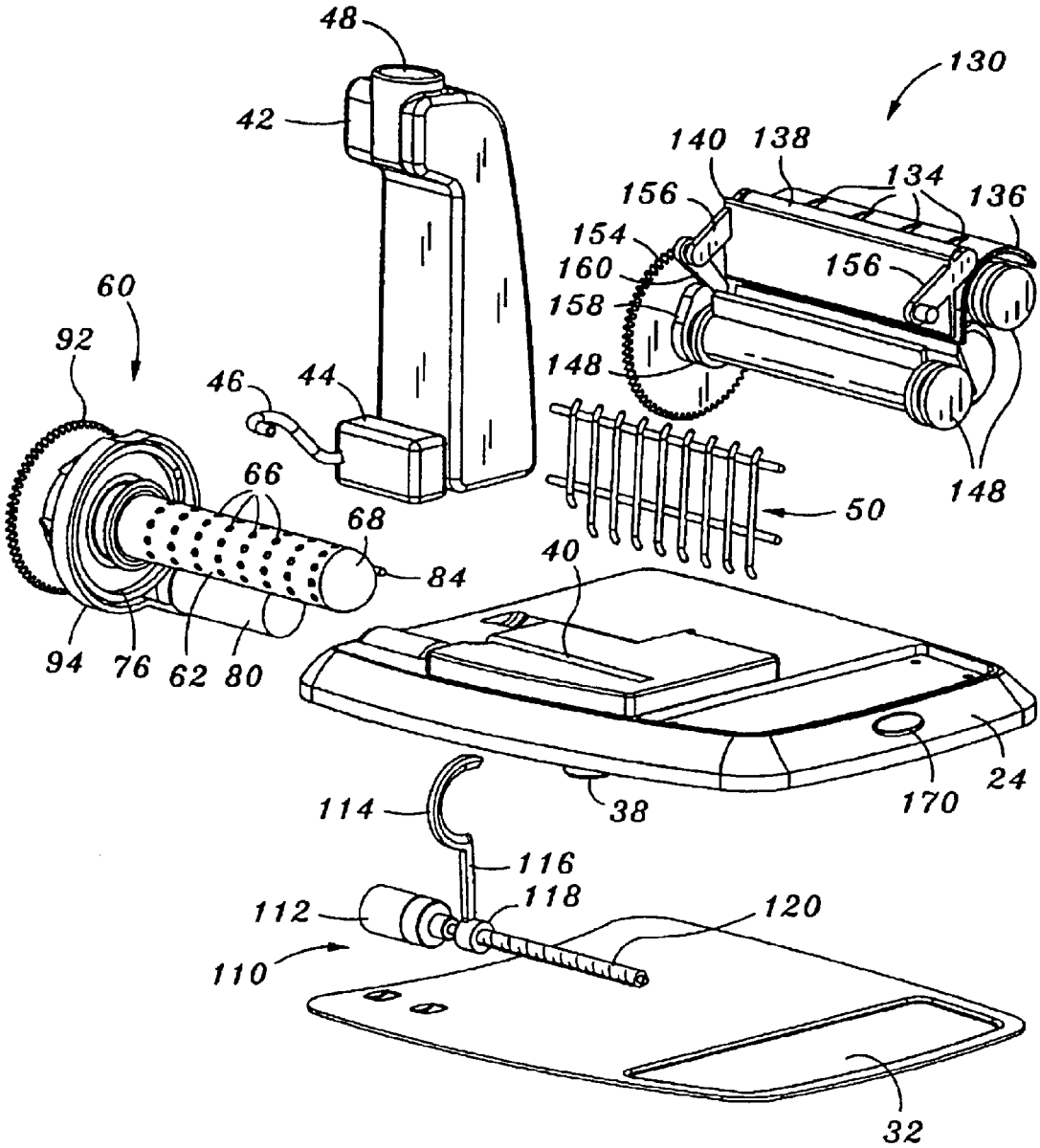
FIG. 4 is an exploded perspective view of the hygienic wipes steamer of FIG. 1 and illustrating a liquid container, a roller assembly, a rotatable heater assembly and an ejector assembly that make up the hygienic wipes steamer.

Referring now to the drawings wherein the showings are for purposes of illustrating a preferred embodiment of the present invention only, and not for purposes of limiting the same, FIGS. 1–3 perspectively illustrate a hygienic wipes steamer 10 constructed in accordance with the present invention. FIG. 4 perspectively illustrates an exploded perspective view of the hygienic wipes steamer. As was indicated above, the hygienic wipes steamer 10 is adapted to provide individual, warmed and moistened hygienic wipes 12 from a roll of uncut, dry, non-woven or paper material.

In its broadest sense, the hygienic wipes steamer 10 comprises the housing assembly 20, a liquid container 42, a roller assembly 130 and a heater assembly 60 all disposed within the housing assembly 20. An ejector assembly 110 may be also included within the housing assembly 20 for ejecting warmed and moistened hygienic wipes 12 from the hygienic wipes steamer 10. Advantageously, the hygienic wipes steamer 10 is configured such that an individual hygienic wipe 12 may be quickly produced upon activation of the hygienic wipes steamer 10. Furthermore, the individual hygienic wipes 12 are produced in a cost effective manner using a roll of material.

Referring to FIGS. 1–4, shown is the housing assembly 20 which is comprised of a housing body 22 that is secured to a housing base 24 at a periphery thereof. The housing body 22 and housing base 24 collectively define an interior housing compartment. The housing body 22 includes a pair of opposed, spaced housing side walls 26 and a pair of opposed, spaced housing end walls 30. In addition, the housing body 22 includes a housing top wall 28 which is joined to the housing side walls 26 and the housing end walls 30.

In order to gain access to the interior compartment, portions of the housing side walls 26 and/or portions of the housing end walls 30 may be configured to be at least partially removable such that the material roll 14 may be installed and replaced, or to allow access to the housing interior compartment for maintenance or parts replacement purposes. Toward this end, portions of the housing side walls 26 as well as portions of the housing top wall 28 may be configured to be hingeable and outwardly moveable in a clam shell door manner. When such portions are hinged away from each other, access may be provided to the housing interior compartment.

Referring to FIG. 2, shown is the hygienic wipes steamer 10 having portions of the housing side walls 26 and portions of the housing top walls 28 removed to illustrate the installation of the heater assembly 60 and of the roller assembly 130. Also shown in FIG. 2 is a pair of spaced apart support walls 36 disposed in generally parallel relation to one another. The support walls 36 are configured to provide rigid support for the heater assembly 60 and the roller assembly 130 as well as provide support for mounting of the material roll 14. As can be seen in FIG. 2, formed within one of the support walls 36 is a wipe aperture 34 which allows ejection of a warmed hygienic wipe 12 therethrough.

Although the housing assembly 20 of the hygienic wipes steamer 10 is shown as being generally rectangular or orthogonally shaped, it is contemplated that the housing assembly 20 may be configured in a variety of alternative shapes and sizes. For example, the housing assembly 20 and, more particularly, the housing body 22 may be provided in a generally rounded configuration. For example, the housing assembly 20 may be configured in an oval or a circular shape. However, the generally rectangular shape of the housing assembly 20 shown in FIGS. 1–3 is believed to be advantageous in regards to packaging of the components within a confined space of the housing interior compartment as well as providing compatibility within a home environment such as on a bathroom counter top.

Referring to FIGS. 1–4, the housing body 22 may be peripherally secured to the housing base 24 although other configurations for securing the housing body 22 to the housing base 24 are contemplated. For example the housing body 22 and the housing base 24 may be formed as a unitary structure wherein access doors are provided at strategic locations around the housing body 22 to provide access to the interior compartment. As shown in FIG. 2, the support walls 36 may be also engaged to the housing base 24 at a lower end of the support walls 36. A removable base cover plate 32 may be secured to an underside of the housing base 24 in order to encapsulate the ejector assembly 110 therewithin. The base cover plate 32 may include apertures formed therewithin to facilitate mounting of the support walls 36 and other components of the hygienic wipes steamer 10.

As can be seen in FIGS. 1–4, the housing base 24 may have a plurality of foot pads 38 spaced about a perimeter thereof The foot pads 38 may facilitate supporting the hygienic wipes steamer 10 on a surface such as a counter top or a table. Such foot pads 38 may be constructed of an elastomeric material in order to facilitate the nonslidable support of the hygienic wipes steamer 10. It is contemplated that the housing assembly 20 may be fabricated from a plastic material although other materials such as metallic materials may be used. In this regard, it is contemplated that the housing assembly 20 may be fabricated from any suitable material that can provide the necessary structural, produceablity as well as aesthetic qualities that may be required. In addition, the housing assembly 20 may be fabricated in any one of a wide variety of textures and/or surface finishes that are compatible with the intended application. In order to provide additional protection against the formation or growth of harmful micro-organisms in the hygienic wipes steamer 10, it is contemplated that the liquid container 42 may be molded of plastic having an anti-microbial additive. In this regard, it is contemplated that any of the components of the hygienic wipes steamer 10 may be fabricated of plastic having the anti-microbial additive.

Referring now to FIGS. 1–4 and FIG. 6, shown disposed on an exterior of the housing base 24 is an activation/indication mechanism 170. The activation/indication mechanism 170 may be configured as either an activation device or an indication device or both. If provided as an activation device, it is contemplated that the activation/indication mechanism 170 may comprise a switch for initializing and activating the operation of the hygienic wipes steamer 10. As will be described in greater detail below, once the switch is engaged, power may be provided to the heater assembly 60 such that the heating element 70 is raised to the appropriate temperature prior in order to allow the hygienic wipes steamer 10 to generate an individual hygienic wipe 12 from the material roll 14.

When the heating element 70 reaches the desired temperature, the indication device, which may be configured as a light member, may be operative to indicate that the roller assembly 130 is ready for taking up material from the material roll 14. Optionally, the hygienic wipes steamer 10 may be operative to automatically cause the roller assembly 130 to take up material from the material roll 14. Once the roller assembly 130 is activated, the roller assembly 130 initiates the threading of a leading edge 18 of the material roll 14 through the hygienic wipes steamer 10 for ultimate production of a moistened and warmed hygienic wipe 12. It is contemplated that the hygienic wipes steamer 10 may include the appropriate processing circuitry (e.g., a processor or a microprocessor) and software such that the hygienic wipes steamer 10 is operative to automatically dispense a present or unlimited quantity of hygienic wipes 12 once the hygienic wipes steamer 10 is activated. However, it is also contemplated that the processing circuitry is operative to cause the hygienic wipes steamer 10 to produce only a single hygienic wipe 12 each time the switch is depressed.

Furthermore, the processing circuitry may be operative to cause the hygienic wipes steamer 10 to automatically shut off after a predetermined amount of time (e.g., after ten or fifteen seconds from activation) as a safety feature to prevent overheating of the hygienic wipes steamer 10. In this regard, the hygienic wipes steamer 10 may be configured to automatically go into "sleep" mode. It will be appreciated that there are a wide variety of alternative modes and operational configurations that may be provided for initializing the hygienic wipes steamer 10, activating the threading of the leading edge 18 through the roller assembly 130, automatically dispensing an infinite number or a finite number of hygienic wipes 12, or manually dispensing a single one of the hygienic wipes 12 upon activation of the hygienic wipes steamer 10.

Other modes and operational configurations that may be provided for in the processing circuitry of the hygienic wipes steamer 10 include initializing the hygienic wipes steamer 10 autonomously or manually shutting off the hygienic wipes steamer 10 and a variety of other modes of operation. In addition, further activation/indication mechanisms 170 may be incorporated into the hygienic wipes steamer 10 in order to provide an indication as to various operating parameters of the hygienic wipes steamer 10 such as, for example, a low water alert mechanism such as an audible warning signal or a flashing or steady light to indicate that the liquid container 42 is at a low liquid level. In addition, the hygienic wipes steamer 10 may include means for adjusting the temperature at which hygienic wipes 12 are ejected. For example, the hygienic wipes steamer 10 may be preprogrammed to delay ejection of the hygienic wipes 12 for an appropriate amount of time until the hygienic wipe 12 is heated to one of a low temperature, a medium temperature, a high temperature or any other temperature setting.

Referring now more particularly to FIG. 3, shown is the material roll 14 mounted within the housing compartment of the housing assembly 20. As can be seen in FIG. 3, the material roll 14 is oriented in a direction that is generally parallel to the housing side walls 26. Furthermore, the material roll 14 is disposed at a lower portion of the housing assembly 20 and is positioned above the housing base 24. It is contemplated that the material roll 14 is rotatably supported within the housing assembly 20 such that the material roll 14 can be threaded upwardly toward the roller assembly 130. However, it is contemplated that various other orientations and positions for locating the material roll 14 may be provided.

Referring now briefly to FIG. 4, shown is an exploded perspective view of the hygienic wipes steamer 10 illustrating the liquid container 42, the roller assembly 130, the rotatable heater assembly 60 and the ejector assembly 110 that make up the hygienic wipes steamer 10. The liquid container 42 is disposed within the housing assembly 20 and is configured for storing a quantity of liquid therein. As shown in FIG. 4, the liquid container 42 is disposed at one of a pair of ends of the material roll 14. In addition, the hygienic wipes steamer 10 is located adjacent one of the housing side walls 26 of the housing assembly 20 near a comer thereof.

The liquid container 42 as shown in FIG. 4 is configured as an elongate vertically oriented housing member having a fill port 48 disposed at an upward end of the liquid container 42. As shown in FIG. 2, an aperture is provided in the housing top wall 28 and is sized complimentary to a size and configuration or shape of the fill pert 48. In this manner, the liquid container 42 may be refilled with liquid simply by pouring liquid through the fill port 48. It is contemplated further, that the liquid container 42 may form a portion of one of the housing side walls 26. Furthermore, a portion of the liquid container 42 may form a portion of the housing top wall 28. However, it is contemplated that there are a wide variety of alternative configurations for shapes and sizes of the liquid container 42. The hygienic wipes steamer 10 may be configured such that the liquid container 42 is visible through the side walls 26 or end wall 30. In this manner, the level of the liquid within the liquid container 42 may be easily checked by visual observation.

The liquid container 42 may be fabricated of any suitable material and may be preferably fabricated of plastic material such as by an injection molding process. However, it is contemplated that the liquid container 42 may be fabricated of metallic material, fiberglass material, or any suitable alternative. As was previously mentioned, the liquid container may be fabricated by plastic that includes an antimicrobial plastic to prevent growth of microorganisms.Although the liquid container 42 is shown configured as an elongate member in FIG. 4, it is contemplated that the liquid container 42 may be disposed in any location to provide easy filling and refilling thereof For example, instead of opening toward the housing top wall 28 as is shown, the fill port 48 of the liquid container 42 may be oriented to open into one of the housing side walls 26 or housing end walls 30. However, the configuration of the liquid container 42 shown in FIG. 4 is believed to be advantageous in providing maximum volume for the liquid container 42 within the confined spaces of the interior compartment.

Disposed at a lower end of the liquid container 42 and fluidly connected thereto is a pump unit 44. The pump unit 44 is preferably configured to pump liquid from the liquid container 42 into the heater assembly 60. As can be seen in FIG. 4, a liquid conduit 46 fluidly connects the pump unit 44 to the heater assembly 60. The liquid conduit 46 may be comprised of plastic, elastomeric tubing or metallic tubing, etc. The pump unit 44 may be disposed adjacent to or abutting up against a side of the liquid container 42 as shown in FIG. 4. As will be described in greater detail below, when the hygienic wipes steamer 10 is activated are the heating element 70 is warmed, the pump unit 44 pumps liquid from the liquid container 42 into the heater assembly 60.

Figure 5:
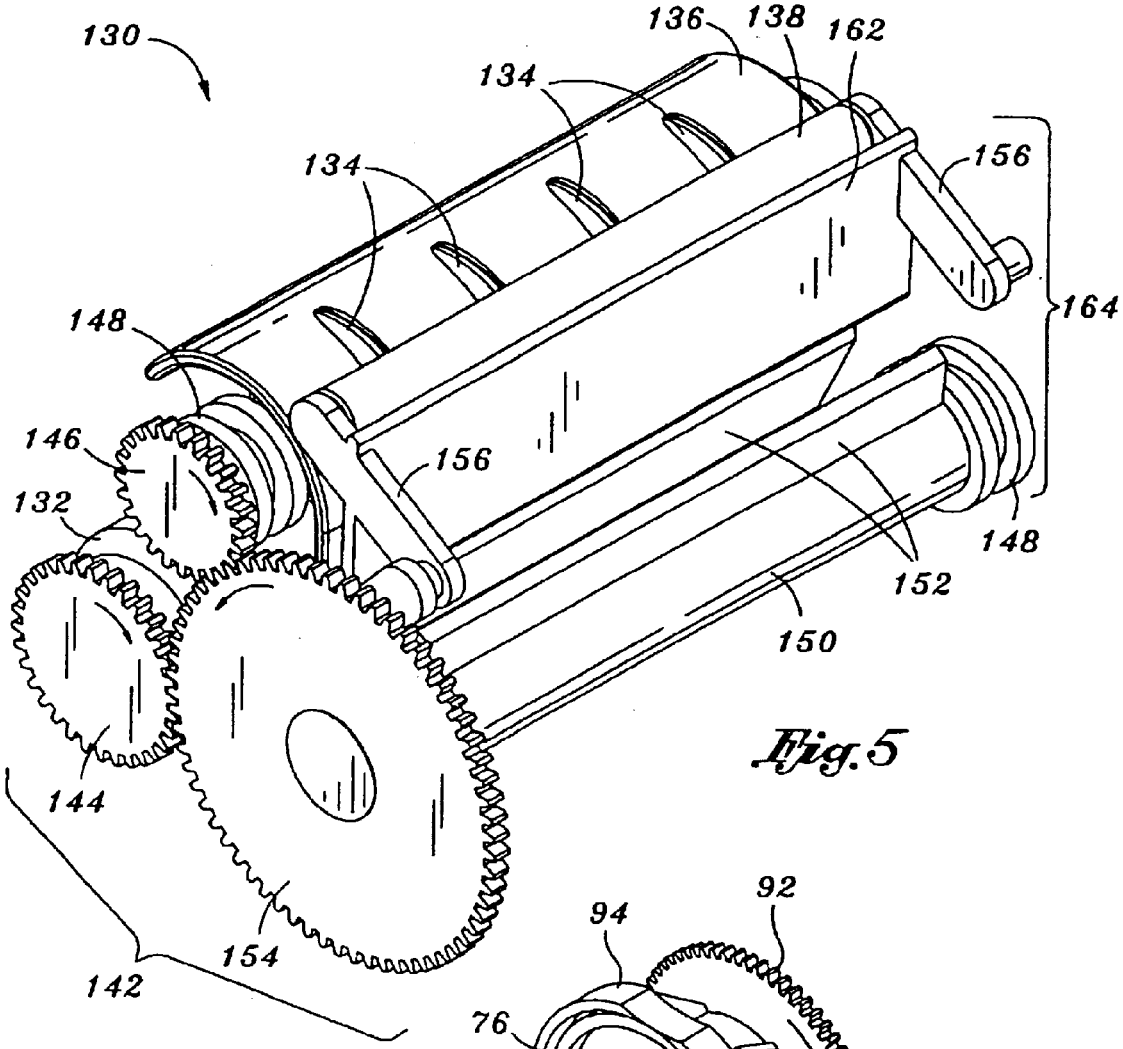
FIG. 5 is a perspective view of the roller assembly and illustrating a pair of shear blades operatively coupled thereto.

Referring now to FIGS. 3–5, shown is the roller assembly 130 disposed in an upward portion of the interior compartment. The roller assembly 130 may be supported by the support walls 36 as shown in FIG. 2. The roller assembly 130 is disposed above the material roll 14 and receives the leading edge 18 of material from the material roll 14. In its broadest sense, the roller assembly 130 comprises a roller motor 132 and may optionally include a cutting mechanism 164. The roller motor 132 is adapted to receive the leading edge 18 of the material roll 14. The roller assembly 130 includes a wipe support member 136 with at least one feed roller 134 or a plurality of spaced apart feed rollers 134 that partially protrude through the wipe support member 136.

As can be seen in FIG. 5, the wipe support member 136 has a partially cylindrical shape and is configured in such a manner so as to guide the leading edge 18 of the material upwardly from the material roll 14 and over the roller assembly 130 and downwardly through the cutting mechanism 164. The wipe support member 136 may alternatively be configured in a wide variety of shapes other than the cylindrical shape. The roller assembly 130 may include a roller gear assembly 142 which may comprise a roller motor gear 144, a blade carrier gear 154 and a feed roller gear 146 as shown in FIG. 5. If the cutting mechanism 164 is not included, the blade carrier gear 154 may be eliminated from the roller assembly 130. The roller motor gear 144 is fixedly secured to the roller motor 132. The feed roller gear 146 is connected to the feed rollers 134.

As was earlier mentioned, feed rollers 134 may partially protrude through the wipe support member 136. Although four (4) feed rollers 134 are shown, any number can be provided. The blade carrier gear 154 is engaged to the roller motor gear 144 and is fixedly secured to the blade carrier 150 which is supported on either end thereof by a pair of bearings 148 as can be seen in FIG. 5. Likewise, the wipe support member 136 and feed rollers 134 are supported by a pair of bearings 148 disposed on either end of the wipe support member 136.

As can be seen in FIG. 3, the bearings 148 for the wipe support member 136 and feed rollers 134 as well as the bearings 148 for the blade carrier 150 are journaled into the support walls 36 of the housing assembly 20. It is contemplated that the bearings 148 may be fabricated of a plastic material although metallic material may also be used to fabricate the bearings 148. Notably, the blade carrier gear 154 has a diameter which is preferably about twice that of the roller motor gear 144. By providing the blade carrier gear 154 in such proportion to the roller motor gear 144, the blade carrier 150 rotates approximately one rotation each time a hygienic wipe 12 is cut from the material roll 14.

It should be noted that cutting mechanism 164 may be altogether eliminated from the roller assembly 130 by providing the material roll 14 with spaced rows of preformed perforations extending across a width of the material similar to the manner in which perforation are included in a roll of paper towels for partitioning into individual paper towels. Likewise, the spaced rows of preformed perforations in the material roll 14 allow for partioning of the material into the individual hygienic wipes 12. In such a configuration, the roller assembly 130 may be configured to effectuate partioning of the material roll 14 into individual hygienic wipes 12 by pulling apart two adjacent hygienic wipes 12 at the perforations. In yet another embodiment of the hygienic wipes steamer 10, the roller assembly 130 may eliminate the need for a cutting mechanism 164 by providing the material roll 14 such that individual hygienic wipes 12 are wound onto the roll 14. The individual hygienic wipes 14 may be separated or partitioned from one another upon unwinding from the material roll 14 by the roller assembly 130.

For configurations of the hygienic wipes steamer 10 including the cutting mechanism 164, the length of material for each individual hygienic wipe 12 is determined by timing of the cutting of the material roll 14 into individual ones of the hygienic wipes 12. In this regard, the length of each hygienic wipe 12 is sized according to the relative diameters of the blade carrier gear 154 with respect to the roller motor gear 144 and the feed roller gear 146. For example, providing the blade carrier gear 154 in a larger diameter results in a longer length of the individual hygienic wipe 12. Although the roller assembly 130 is shown having a roller gear assembly 142 as the driving mechanism for rotating the respective components of the roller assembly 130, it is also contemplated that a pulley system may be adapted to provide rotational motion for the various components of the roller assembly 130. In this regard, it is contemplated that various other drive means may be adapted to provide rotational motion to the blade carrier 150 as well as to the feed rollers 134.

Regarding the configuration of the cutting mechanism 164, the blade carrier 150 shown FIG. 5 has a pair of spaced apart shear blades 152 each having a sharpened edge for shearing off a length of material into the individual hygienic wipes 12. It is contemplated that the shear blade 152 located adjacent to the feed roller 134 is resiliently mounted to allow for springing backward against pressure applied by the shear blade 152 that is mounted on the blade carrier 150. In this manner, the shear blade 152 that is affixed to the blade carrier 150 may effectively cut the material roll 14 into the individual hygienic wipe 12.

As can also be seen in FIGS. 3–5, a pinch roller 138 is disposed against the feed rollers 134 to capture the leading edge 18 of the material roll 14 and frictionally guide and pull the leading edge 18 down over the wipe support member 136 and through the shear blades 152. The pinch roller 138 is mounted on a pinch roller bracket 140 which also includes a guide plate 162 which may be generally vertically disposed. On opposite ends of the pinch roller bracket 140 are a pair of roller arms 156 extending outwardly therefrom at a slight downward angle. The roller arms 156 can also be seen in FIG. 5. As was earlier mentioned, the guide plate 162 is vertically disposed in order to guide the leading edge 18 of the material roll 14 down through the shear blades 152.

On at least one end of the pinch roller bracket 140 is a cam follower 160 which is configured to ride on a roller cam 158. The roller cam 158 may be integrally formed with the blade carrier gear 154. The configuration of the cam follower 160 and roller cam 158 in conjunction with the pinch roller bracket 140 is such that pressure between the pinch roller 138 and the feed rollers 134 is temporarily or momentarily released in order to allow cutting of the sheet 16 of material by the shear blades 152. More specifically, the momentary release of pressure between the pinch roller 138 and the feed rollers 134 prevents bunching up of the material from the roll during cutting of the sheet 16. It is contemplated that the pinch roller bracket 140, including the roller arms 156 and the guide plate 162, are fabricated as a unitary structure such as by injection molding using a plastic material or other suitable material. However, the pinch roller bracket 140 may be fabricated of a metallic material. Likewise, it is contemplated that the roller assembly 130 including the blade carrier gear 154, the roller motor gear 144 and the feed roller gear 146, may be fabricated of a plastic material such as also by injection molding.

Regarding the configuration of the cutting mechanism 164, although the pair of shear blades 152 in conjunction with the guide plate 162 has been described above as providing the means for partitioning the material into the individual hygienic wipes 12, it is also contemplated that the cutting mechanism 164 may be provided in a wide variety of configurations. For example, the cutting mechanism 164 may comprise a roller cutter that is configured to cut the material into hygienic wipes 12 by cutting across a width of the material roll 14. The cutting mechanism 164 may be provided in a wide variety of alternative cutting means.

Referring to FIGS. 2 and 4, disposed immediately below the roller assembly 130 and oriented in a generally vertical manner is a wipe guide grill 50. The wipe guide grill 50 is preferably oriented and configured to prevent the material from curling back underneath the roller assembly 130 after cutting thereof by the cutting mechanism 164. More specifically, the wipe guide grill 50 is configured to allow the heater assembly 60 to successively take up the individual hygienic wipes 12 from the roller assembly 130. As can be seen in FIG. 4, the wipe guide grill 50 is generally comprised of a spaced set of elongate tubular or rod-like members which are joined by a pair of spaced and horizontally oriented rod-like or tubular members.

The wipe guide grill 50 may be formed by injection molding as a unitary structure of plastic material or alternatively metallic material may be used to fabricate the wipe guide grill 50. Extreme ends of the vertically oriented elongate members of the wipe guide grill 50 may be angled to prevent snagging of the material thereon and to allow effective take up of the material by the heater assembly 60. The wipe guide grill 50 may alternatively be configured as a homogenous sheet of material such as sheet metal material. In this regard, the wipe guide grill 50 may be provided in any suitable configuration and in any size, shape and orientation effective to prevent curling of the individual hygienic wipe sheets underneath the roller assembly 130 and to guide the individual hygienic wipe sheets onto the heater assembly 60.

Referring now to FIGS. 2–8, shown is the heater assembly 60 of the hygienic wipes steamer 10. As can be seen, in FIG. 2, the heater assembly 60 is disposed adjacent the material roll 14 at a lower portion of the housing assembly 20. Generally, the heater assembly 60 is cantilevered off one of the support walls 36 opposite a side of the housing assembly 20 having a wipe aperture 34 formed therethrough, as is shown in FIG. 1. The heater assembly 60 is configured to rotate within the housing assembly 20 and to receive and warm individual hygienic wipes 12 in successive manner. The heater assembly 60 generally comprises a heater motor 80 and a heater tube 62 that is coupled to the heater motor 80 and which is in fluid communication with the liquid container 42.

Figures 6, 8:
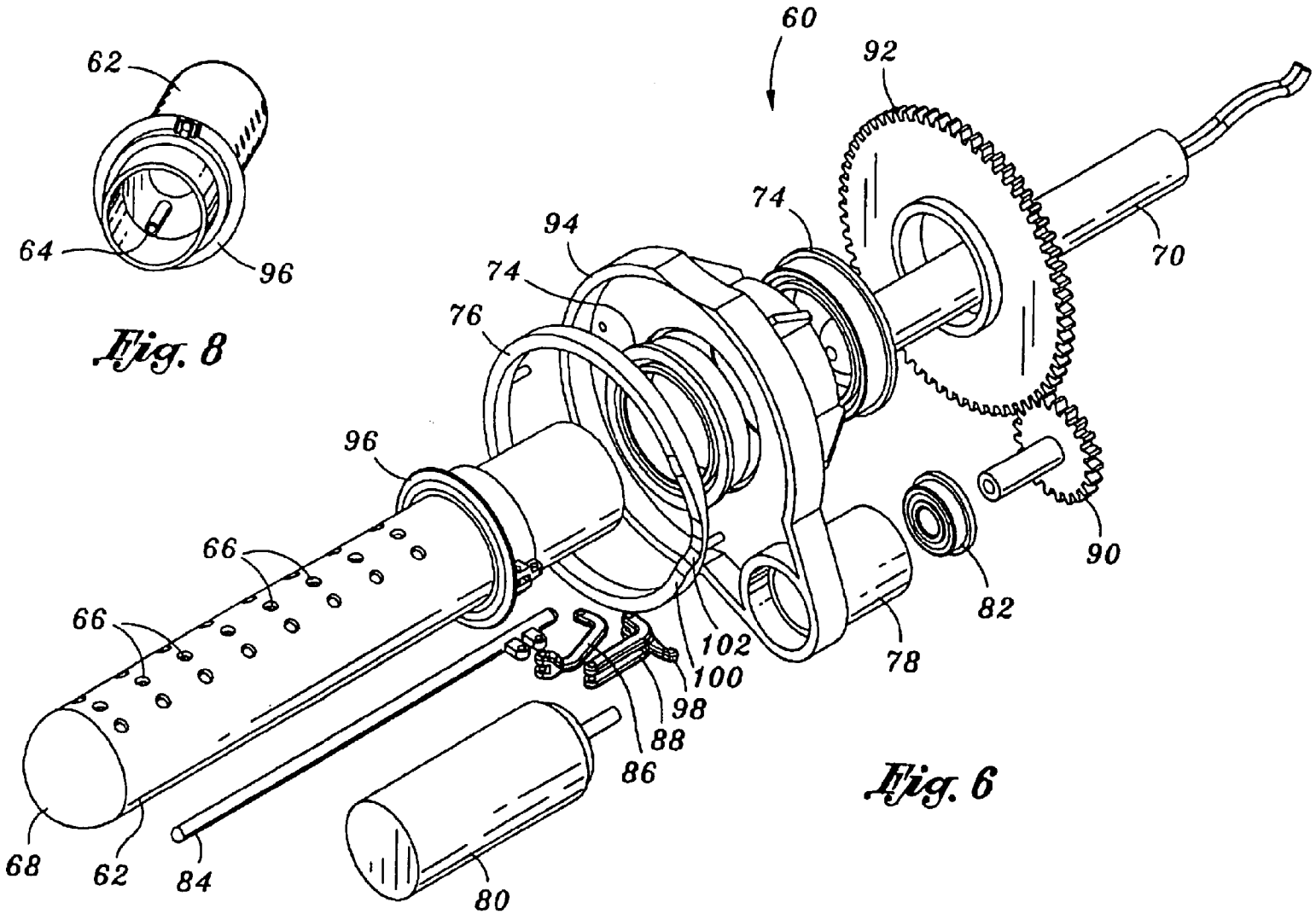
FIG. 6 is an exploded perspective view of the rotatable heater assembly and illustrating a plurality of steam holes formed through a heater tube and further illustrating a clamping rod operatively engaged to the heater tube.
FIG. 8 is perspective view of the heater tube illustrating a fluid injection tube disposed therewithin.

The heater tube 62 may be provided in a cylindrical configuration with a diameter of about one inch although the heater tube 62 may be provided in any size, shape and configuration. The heater tube 62 is configured to have at least one steam hole 66 although a plurality of steam holes 66 may be formed therealong. Disposed within the heater tube 62 is the heating element 70 as shown in FIG. 6. As shown in FIG. 6, the heating element 70 may have a diameter of about one-half inch and a length of about four inches. The heating element 70 may be configured to provide a heat output of approximately one thousand watts to the heater assembly 60.

However, the heater element may be configured in a variety of alternative sizes and shapes. Furthermore, the heat output of the heating element 70 may be provided in a wide range of settings. As shown in FIGS. 2–8, the heater tube 62 itself includes the plurality of steam holes 66 formed therethrough and spaced circumferentially and axially along the heater tube 62. A spherical end cap 68 may be provided to close out an end of the heater tube 62. Also dispose within the heater tube 62 is a liquid injection tube 64 as shown in FIG. 8. The liquid injection tube 64 is fluidly connected to the pump unit 44 through the liquid conduit 46. The liquid conduit 46 and the pump unit 44 can be seen in FIG. 4.

Figure 7:
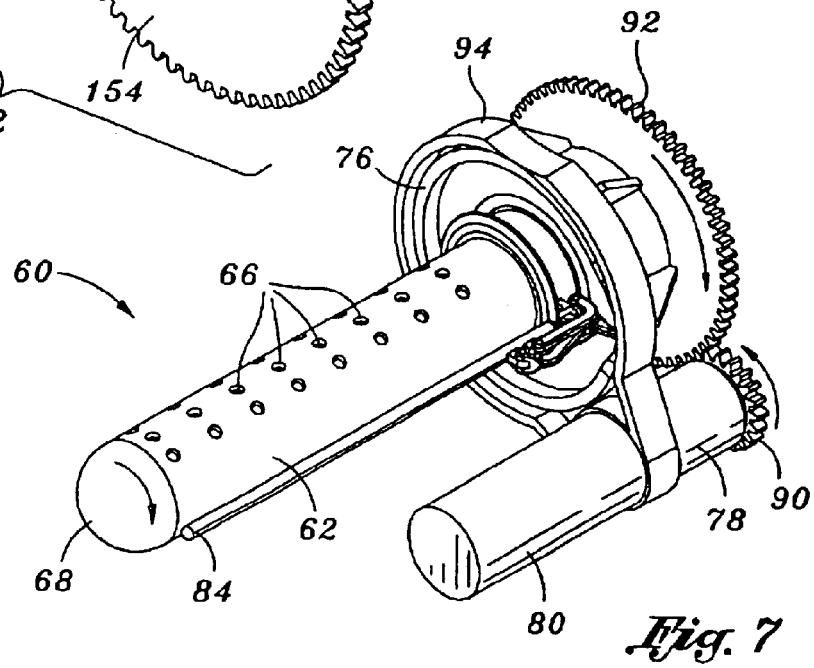
FIG. 7 is a perspective view of the rotatable heater assembly in its fully assembled state.

Referring now to FIGS. 6–7, included with the heater assembly 60 is a heater bracket 94 for coupling the heater motor 80 to the heater tube 62. As shown in FIG. 6, the heater bracket 94 is configured to provide rotational support for the heater tube 62 and fixed support for the heater motor 80. The heater bracket 94 includes a support housing 78 for securing the heater motor 80 thereto. A motor bearing 82 may be included in the support housing 78 to provide rotational support for the heater motor 80. The motor bearing 82 may be a flanged shielded motor bearing 82. Fixedly secured to the shaft of the heater motor 80 may be a heater motor gear 90 as can be seen in FIG. 6. The heater motor gear 90 has an axle which passes through the motor bearing 82 and is engaged to the heater motor 80.

The heater tube 62 is rotationally supported on the heater bracket 94 by a pair of ball bearings 74 as can be seen in FIG. 6. The ball bearings 74 may be flanged shielded ball bearings 74 that are mounted on opposing sides of the heater bracket 94. A heater tube gear 92 may be fixedly secured to the heater tube 62 on an opposite side of the heater bracket 94 from which the heater tube 62 extends. As can seen in FIG. 6, the heater motor gear 90 is cooperatively engaged to the heater tube gear 92 such that activation of the heater motor 80 causes rotation of the heater motor gear 90 which, in turn, causes the heater tube gear 92 and, hence, the heater tube 62 to rotate. The gear ratio between the heater motor gear 90 and the heater tube gear 92 may be configured to provide a predesired rotational rate of the heater tube 62 such that, ultimately, the desired amount of steam may be infused into each of the individual hygienic wipes 12 prior to ejection thereof out of the housing assembly 20.

Circumferentially mounted on the heater tube 62 may be a link bracket 96 as shown in FIG. 6. Secured to the link bracket 96 may be a first link 86 and a second link 88 which are pivotally connected to a clamping rod 84 of the heater assembly 60. The first link 86 and the second link 88 connect the clamping rod 84 to the link bracket 96 as a four bar linkage to allow the clamping rod 84 to move radially inwardly and outwardly relative to the heater tube 62 during rotation of the heater tube 62. Such inward and outward radial motion is achieved through the inclusion of a generally circular shaped push ring 76 which is cooperatively engaged to the heater bracket 94 as can be seen in FIG. 6.

The push ring 76 may include a pair of diametrically opposed pins which are receivable into corresponding holes formed in the heater bracket 94. As can be seen in FIG. 6, the second link 88 may include a link arm 98 formed thereon and extending laterally outwardly therefrom. The link arm 98 is configured to ride along a circumferential ramp surface 100 formed on the push ring 76 during rotation of the heater tube 62. A portion of the ramp surface 100 may be dished or indented such that the radially inward and outward motion of the clamping rod 84 may be effectuated to alternately clamp and unclamp successive ones of the hygienic wipes 12 to the heater tube 62.

More specifically, due to the fixed (i.e., relatively non-moveable) connection of the push ring 76 to the heater bracket 94 and further in consideration of the rotational motion of the heater assembly 60 and, hence, the first and second links 86, 88, the clamping rod 84 remains clamped to a side surface of the heater tube 62 during a majority of each revolution of the heater tube 62. However, the clamping rod 84 moves radially outwardly from the heater tube 62 (i.e., unclamps from the heater tube 62) during a portion of each revolution of the heater tube 62 when the link arm 98 is momentarily engaged within the depression 102. In this manner, the push ring 76 remains clamped against the heater tube 62 during a majority of the duration of each revolution of the heater tube 62. However, the clamping rod 84 is temporarily unclamped during a minor portion of each revolution of the heater tube 62 during engagement of the link arm 98 with the depression 102 of the ramp surface 100 of the push ring 76.

Preferably, the heater assembly 60 is configured such that the clamping rod 84 momentarily unclamps from the heater tube 62 during each ejection of one of the hygienic wipes 12 off of the heater assembly 60. In addition, the heater assembly 60 is preferably configured such that the clamping rod 84 remains unclamped from the heater tube 62 during receipt of an additional one of the hygienic wipes 12 from the roller assembly 130. Once the hygienic wipe 12 is guided between the unclamped clamping rod 84 and the heater tube 62, engagement of the link arm 98 with the ramp surface 100 of the push ring 76 causes clamping of the hygienic wipe 12. Further rotational motion of the heater tube 62 causes the individual hygienic wipe 12 to be wrapped around an exterior surface of the heater tube 62.

Referring to FIG. 7, the hygienic wipes steamer 10 is preferably configured such that two revolutions are required for each one of the hygienic wipes 12 prior to unclamping and ultimately ejection of the hygienic wipe 12 out of the housing assembly 20. However, it is contemplated that the hygienic wipes steamer 10 may be configured with alternative gear ratios between the heater motor gear 90 and the heater tube gear 92 as well as alternative diametrical sizes and shapes of the heater tube 62 itself such that any number of rotations or variations of the heater tube 62 may be effectuated prior to ejection of the hygienic wipe 12 off of the heater assembly 60 and out of the housing assembly 20.

Regarding material from which the heater assembly 60 may be fabricated, it is contemplated that a majority of the components may be fabricated of a plastic material using an injection molding process. However certain components such as the ball bearings 74, may be fabricated of metallic material. In addition, the motor bearing 82 may be fabricated of a metallic material. In this regard, any of the components that comprise the heater assembly 60 may be fabricated in any material that is suitable to effectively provide the durability, strength and reliability required for the heater assembly 60.

Referring briefly to FIGS. 3 and 7, it is contemplated that the hygienic wipes steamer 10 may be configured such that the individual hygienic wipes 12 are transferred from the roller assembly 130 to the heater assembly 60 wherein the heater assembly 60 rotates in a clockwise direction viewing the heater tube 62 in a direction from the end cap 68 toward the heater motor 80. In this regard, the direction of rotation of the material roll 14 is preferably opposite that of the heater assembly 60. However, the hygienic wipes steamer 10 may be configured in any configuration with rotational direction of the components being variable depending on the desired amount of warming and moisturizing for each one of the individual hygienic wipes 12 prior to ejection.

Activation of the heater motor 80 is preferably such that rotational motion of the heater tube 62 is provided wherein the heater tube 62 successfully receives hygienic wipes 12 from the roller assembly 130 with the clamping rod 84 being operative to clamp and unclamp successive ones of the hygienic wipes 12. When one of the hygienic wipes 12 is wound around the heater tube 62, the hygienic wipes steamer 10 is preferably configured such that the pump unit 44 is activated to draw an amount of liquid from the liquid container 42 for delivery to the steamer assembly. The liquid flowing into the heater tube 62 is then transformed into steam due to contact of the liquid with the heated environment within the heater tube 62. Such heat is provided by the heating element 70, as was earlier described. Such transformation of the liquid into the steam may be provided under a phenomenon of flashing wherein the liquid is quickly vaporized due to an extreme change in temperature between that of the liquid and the heated temperature inside the heater tube 62. The resulting steam passes through the steam holes 66 and warms and/or irrigates each one of the hygienic wipes 12 prior to ejection of the hygienic wipe 12 out of the housing assembly 20

Figure 9:
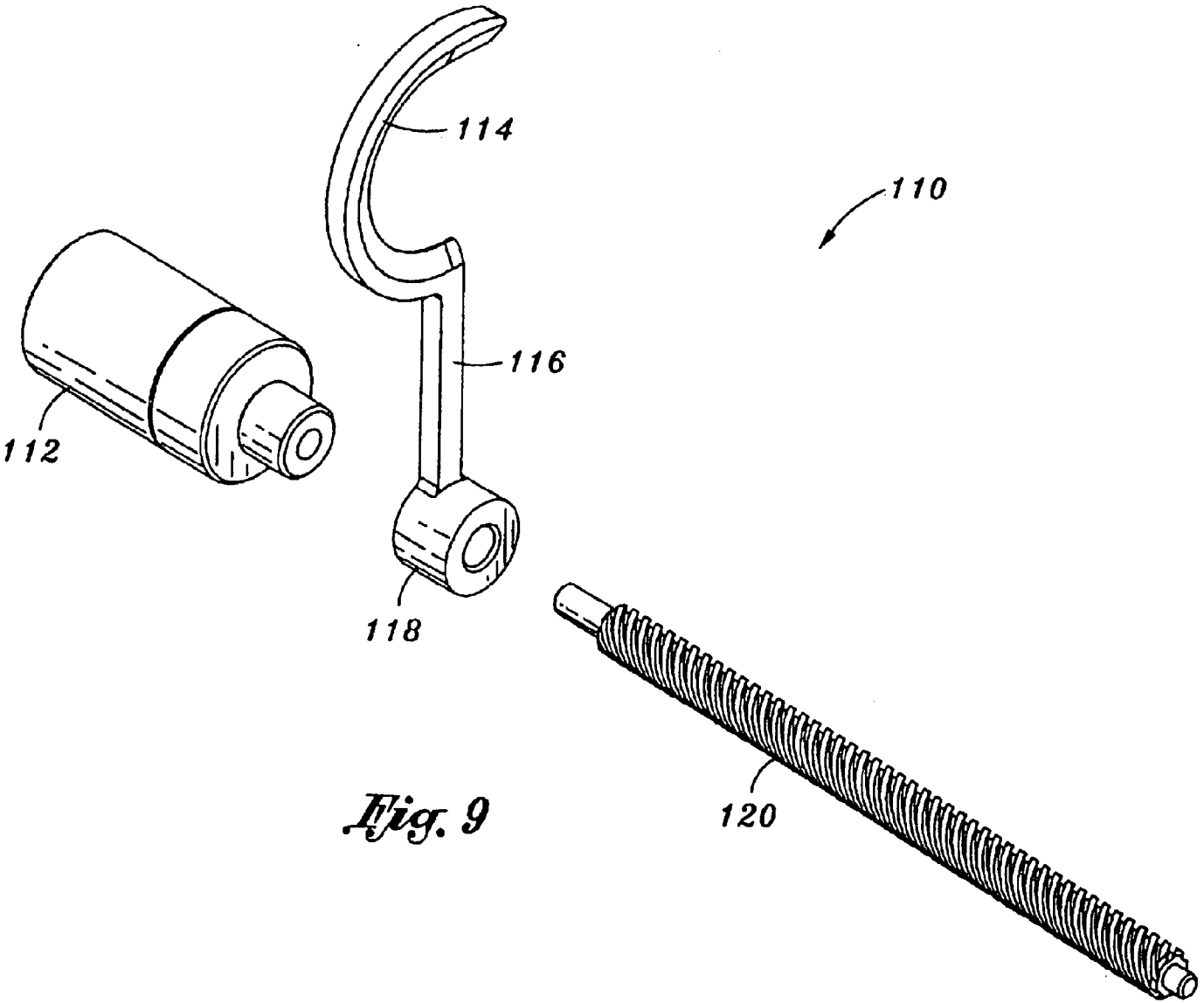
FIG. 9 is an exploded perspective view of the ejector assembly illustrating an ejector motor, a drive screw and an ejector hook that make up the ejector assembly.

The hygienic wipes steamer 10 may also include the ejector assembly 110 as shown in FIGS. 3, 4 and 9. The ejector assembly 110 is disposed within the housing and is located at the lower portion of the housing assembly 20, as shown in FIG. 3. The ejector assembly 110 essentially comprises an ejector motor 112, a drive screw 120 which is nonrotatably connected to the ejector motor 1 12, and an ejector hook 114 which is threadably engaged to the drive screw 120. The ejector assembly 110 is mounted between the base cover plate 32 and the housing base 24, as shown in FIG. 4.

The drive screw 120 of the ejector motor 112 may be secured to one end of the ejector motor 112 and to an opposite end at the housing base 24. The ejector hook 114 is mounted on the drive screw 120 and includes a hook sleeve 118 and a hook arm 116 extending laterally outnvardly therefrom. The hook sleeve 118 includes threads formed therein which are formed complimentary to and engageable with threads formed on the drive screw 120. On an end of the hook arm 116 is the ejector hook 114 which is formed as a semicircular shaped member that is sized to be compatible with an outer diameter of the heater tube 62.

The ejector assembly 110 is preferably configured such that the ejector hook 114 is initially disposed at an end of the heater assembly 60 adjacent the heater bracket 94. Furthermnore, the ejector assembly 110 is preferably operative (i.e., via a processor or microprocessor) to initialize the ejector hook 114 at the end adjacent the heater bracket 94 after ejecting one of the hygienic wipes 12 and prior to receipt of another one of the hygienic wipes 12 by the heater assembly 60. The heater motor 80 is therefore preferably operative to cause rotation of the drive screw 120 in opposite directions such that axial motion of the hook sleeve 118 may thereby be provided in opposite directions via rotation of the drive screw 120.

It is contemplated that the hook sleeve 118 may be sized to fit over a portion of the heater tube 62. It is contemplated that the ejector hook 114, the hook arm 116, and the hook sleeve 118 may be formed as a unitary structure such as by plastic injection molding. However, the ejector hook 114, hook arm 116 and hook sleeve 118 may be formed of any material such as metallic material suitable for achieving ejection of the wipe from the housing assembly 20. Likewise, the drive screw 120 may be fabricated of a suitable material such as plastic or metallic material. The ejector assembly 110 is preferably configured such that activation of the ejector motor 112 causes rotational motion of the drive screw 120 in opposite directions which effectuates axial motion of the ejector hook 114 along the drive screw 120 in opposite directions.

More specifically, the ejector motor 112 is configured to be bi-directional (i.e., to rotate in a first direction which, in turn, causes the drive screw 120 to also rotate in the first direction. With the ejector hook 114 initially disposed adjacent the ejector motor 112, rotation of the drive screw 120 causes the ejector hook 114 to move toward the wipe aperture 34 shown in FIG. 1. In this manner and with the ejector hook 114 disposed near or abutting the hygienic wipe 12, initial activation of the ejector motor 112 causes the hygienic wipe 12 be removed via a sliding action off of the heater tube 62. The hygienic wipe 12 is thereby ejected out of the housing assembly 20 after warming of the hygienic wipe 12 as a result of the flashing steam. Following ejection of the hygienic wipe 12, the ejector motor 112 is preferably configured, via programing of the processor, to reverse its rotational direction and causing the ejector hook 114 to be axially moved back toward the ejector motor 112 in preparation for removal of another one of the hygienic wipes 12.

The operation of the hygienic wipes steamer 10 will now be described with reference to FIGS. 1–9. Prior to activation of the hygienic wipes steamer 10, the material roll 14 must be initially mounted within the housing assembly 20 in a manner and location shown in FIG. 3. Preferably, the material roll 14 is oriented such that unwinding of the leading edge 18 of material is from a side of the material roll 14 opposite the adjacent one of the housing side walls 26. The leading edge 18 of the material roll 14 is then threaded upwardly toward the roller assembly 130 (i.e., manually or automatically) and over the wipe support member 136. The leading edge 18 may then be inserted between the feed rollers 134 and the pinch roller 138.

Further threading of the leading edge 18 of the material may be effectuated by either manually rotating the gear motors to cause rotation of the feed rollers 134 or by temporarily activating the roller motor 132 in order to cause the feed roller 134 to rotate. It is contemplated that the hygienic wipes steamer 10 may include the activation switch which causes automatic threading of a fixed amount of the leading edge 18 of the material roll 14 into and through the shear blades 152 of the roll assembly. Once the material roll 14 is threaded into the roller assembly 130, the liquid container 42 may be filled with a desired amount of liquid using the fill port 48. The liquid may comprise water but may be any alternative liquid. Any open access doors of the housing assembly 20 may be secured to the housing body 22.

Upon activation of the hygienic wipes steamer 10, power is provided to the heating element 70 which may be configured as an electrically powered heating element 70. Once the heating element 70 reaches a predefined temperature, the hygienic wipes steamer 10 may provide an indication by means of the activation mechanism, if included, to indicate that the heating element 70 is sufficiently warmed. It is contemplated that the time period required for sufficiently heating the heating element 70 may be in a range of about ten to fifteen seconds although the heating element 70 may be configured to require more or less time to sufficiently heat to the desired temperature.

Once the heating element 70 is sufficiently warmed, an operator may activate the hygienic wipes steamer 10 to initiate movement of the leading edge 18 downwardly through the shear blades 152 via pinching or capturing of the leading edge 18 between the pinch roller 138 and the feed rollers 134 thereof. The blade carrier 150 simultaneously rotates during rotation of the feed rollers 134 causing further downwardly directed motion of the leading edge 18. The blade carrier 150 simultaneously rotates during rotation of the feed roller 134 such that the shear blade 152 of the blade carrier 150 is caused to engage the opposing one of the shear blades 152 in order to effectuate partitioning or cutting of the sheet 16 of material into an individual one of the hygienic wipes 12. During the partitioning or cutting of the material, clamping force between the pinch roller 138 and the feed roller 134 is temporarily released due to cooperative engagement of the cam follower 160 with the roller arm 156 which causes the pinch roller bracket 140 to momentarily move or rotate away from the feed rollers 134, as can be seen in FIG. 3. Such temporary release of pressure between the pinch roller 138 and the feed rollers 134 prevents bunching of the material at the feed roller 134 during cutting of the material.

Simultaneous with cutting of the material into the individual hygienic wipe 12, the clamping rod 84 is moved outwardly away from the exterior surface of the heater tube 62 such that the heater assembly 60 receives a leading edge 18 of the hygienic wipe 12 from the roller assembly 130. The roller assembly 130 and heater assembly 60 are preferably configured such that prior to finishing of the cutting of the material into an individual hygienic wipe 12, the clamping rod 84 clamps the leading edge 18 of the individual hygienic wipe 12 to the heater tube 62. The continuously rotating heater tube 62 then winds the individual hygienic wipe 12 over the exterior surface of the heater tube 62. Activation of the pump unit 44 then causes liquid from the liquid container 42 to flow through the liquid conduit 46 and into the liquid injection tube 64 located inside the heater tube 62 as shown in FIG. 8. A predetermined quantity of fluid is injected into the heater tube 62 which is then flashed into steam upon exposure of the liquid to the heated area of the heater tube 62. As was previously mentioned, the heating element 70 provides heat for heating the interior of the heater tube 62.

The steam then passes through the steam holes 66 formed in the heater tube 62 and warms and irrigates the hygienic wipe 12. Prior to ejection of the hygienic wipe 12 off of the heater tube 62 and out of the housing assembly 20, the clamping rod 84 is caused to be momentarily moved radially outwardly away from the exterior surface of the heater tube 62 due to the cooperation of the first and second links 86, 88 and link arm 98 with the link bracket 96 as well as with the ramp surface 100 and the depression 102 of the push ring 76. Activation of the ejector motor 112 causes rotation of the drive screw 120 which effectuates axial motion of the ejector hook 114. As was earlier mentioned, the ejector hook 114 is preferably initialized at a position adjacent the ejector motor 112 such that, upon activation of the ejector motor 112, the ejector hook 114 abuts against a side of the individual hygienic wipe 12 which is wound on the heater tube 62. The ejector hook 114 then slides the hygienic wipe 12 off of the heater tube 62 and through the wipe aperture 34 out of the housing assembly 20. As shown in FIG. 4, the drive screw 120 is of a length that is substantially equivalent to the heater tube 62 although other lengths of the drive screw 120 are contemplated. In this manner, complete ejection of the hygienic wipe 12 is effected.

The hygienic wipes steamer 10 is preferably configured such that successive ones of the individual hygienic wipes 12 are passed through the roller assembly 130 and cut by the shear blades 152 prior to being received by the heater assembly 60, clamped thereon by the clamping tube, wound around the rotating heater tube 62. prior to flash steaming upon injection of the liquid into the heater tube 62. Following the flash steaming of each one of the individual wipes, the ejector assembly 110 is activated to slidably remove each one of the individual hygienic wipes 12 from the heater assembly 60 and out of the housing assembly 20.

In this regard, it is contemplated that the hygienic wipes steamer 10 may be configured such that successive ones of the hygienic wipes 12 may be automatically steamed and dispensed therefrom with the hygienic wipes steamer 10 being configured to automatically shut off after a predetermined length of time (e.g., thirty seconds) wherein the hygienic wipes steamer 10 may automatically transition into a sleep mode. As was previously mentioned, the hygienic wipes steamer 10 may be configured such that the roller assembly 130 automatically feeds the leading edge 18 of material through the roller assembly 130. Furthermore it is contemplated that the hygienic wipes steamer 10 may be configured such that individual hygienic wipes 12 are dispensed out of any location of the housing assembly 20 in addition to dispensing out of the housing end walls 30 through the wipe aperture 34.

The material roll 14 may be provided in a pretreated condition. For example, the wipes can be treated with various aloes and lotions for babies, infants, toddlers and children. For teenagers, the material roll 14 may be pretreated to be effective against certain types of skin conditions. Furthermore, the hygienic wipes steamer 10 may be configured to receive various size material rolls 14 such as a toilet paper roll. Furthermore, the toilet paper roll may be pretreated with various lotions, ointments and other preparations. A processor may be programmed to activate the roller assembly 130, the heater assembly 60 and the ejector assembly 110 in synchronized mode such that the individual hygienic wipes 12 are efficiently prepared, steamed and ejected out of the hygienic wipes steamer 10. Furthermore, the processor may be preprogrammed to automatically shut off after processing a certain predetermined quantity of hygienic wipes 12. More specifically, the processor is preferably preprogrammed to control the pump unit 44, the roller motor 132, the heater motor 80 and the ejector motor 112 in synchronization with one another.

Additional modifications and improvements of the present invention may also be apparent to those of ordinary skill in the art. Thus, the particular combination of parts described and illustrated herein is intended to represent only certain embodiments of the present invention, and is not intended to serve as limitations of alternative devices within the spirit and scope of the invention.

What is claimed is:

1. A hygienic wipes steamer for warming hygienic wipes, the steamer comprising:

a housing assembly configured for supporting a roll of material therewithin;

a liquid container disposed within the housing assembly for storing a quantity of liquid;

a roller assembly disposed within the housing assembly and configured to receive material unwinding from the roll and successively partition the material into individual hygienic wipes; and a heater assembly disposed within the housing assembly and being in fluid communication with the liquid container, the heater assembly having at least one steam hole formed therealong and a heating element disposed therewithin and being operative to successively receive the hygienic wipes from the roller assembly;

wherein the hygienic wipes steamer is configured such that a portion of liquid flowing into the heater assembly from the liquid container is transformed into steam when heated by the heating element such that the steam passes through the steam hole and successively warms the individual hygienic wipes.

2. The hygienic wipes steamer of claim 1 wherein the material includes spaced rows of preformed perforations extending across a width of the material for partioning the material into the individual hygienic wipes.

3. The hygienic wipes steamer of claim 1 wherein the roller assembly includes a cutting mechanism comprising at least one shear blade operative to successively partition the material into individual hygienic wipes.

4. The hygienic wipes steamer of claim 3 wherein:

the roller assembly includes a roller motor operative to cause unwinding of the material in a manner such that the material passes the shear blade;

the shear blade being operatively coupled to the roller motor in such a manner as to synchronize the cutting of the material during unwinding of the roll.

5. The hygienic wipes steamer of claim 1 further comprising an ejector assembly disposed within the housing and configured to eject the hygienic wipe from the hygienic wipes steamer.

6. The hygienic wipes steamer of claim 5 wherein the ejector assembly comprises:

an ejector motor affixed to the housing assembly;

a drive screw non-rotatably connected to the ejector motor; and an ejector hook threadably engaged to the drive screw;

wherein activation of the ejector motor causes rotational motion of the drive screw effectuating axial motion of the ejector hook such that the hygienic wipe is slidably removed from the heater assembly and ejected out of the housing assembly after warming of the hygienic wipe.

7. The hygienic wipes steamer of claim 1 wherein the housing assembly comprises a housing body secured to a housing base.

8. The hygienic wipes steamer of claim 7 wherein the housing base has a plurality of foot pads configured to support the hygienic wipes steamer on a surface.

9. The hygienic wipes steamer of claim 1 wherein the housing assembly is fabricated from a plastic material.

10. The hygienic wipes steamer of claim 1 wherein the liquid container is formed from plastic having an antimicrobial additive included therein.

11. The hygienic wipes steamer of claim 1 wherein the heating element is an electrically powered heating element.

12. The hygienic wipes steamer of claim 1 wherein the heater assembly includes a heater tube and a heater motor operative to rotate the heater tube.

13. The hygienic wipes steamer of claim 12 wherein the heater assembly includes a clamping rod operatively engageable against the heater tube such that hygienic wipes are alternately clamped to the heater tube during warming of the hygienic wipe.

14. The hygienic wipes steamer of claim 1 wherein the liquid within the liquid container is water.

15. The hygienic wipes steamer of claim 1 further comprising a pump unit fluidly connected between the liquid container and the heater assembly and being operative to pump fluid therebetween.

16. The hygienic wipes steamer of claim 1 wherein the roller assembly includes a pinch roller engageable to at least one feed roller for capturing the material therebetween, the feed roller being driven by the roller motor and cooperating with the pinch roller to draw the material therethrough.

17. A hygienic wipes hygienic wipes steamer for moisturizing hygienic wipes, the hygienic wipes steamer comprising:

a housing assembly having a housing body connected to a housing base having a plurality of foot pads configured to support the hygienic wipes steamer on a surface;

a liquid container disposed within the housing assembly and configured to store a quantity of liquid therein;

a roller assembly disposed within the housing assembly and configured to rotatably support and unwind a continuous roll of material, the roller assembly including:

a roller motor operative to unwind the material; and at least one shear blade operatively coupled to the roller motor;

wherein the roller motor is operative to unwind the material in a manner such that the material passes the shear blade, the shear blade being configured to effectuate intermittent cutting of the material into individual hygienic wipes in synchronization with the unwinding of the roll;

a rotating heater assembly disposed within the housing assembly and including:

a heater motor;

a heater tube coupled to the heater motor and in fluid communication with the liquid container, the heater tube having a plurality of steam holes formed therealong; and a heating element disposed with the heater tube;

a clamping rod operatively engageable against the heater tube; and wherein activation of the heater motor causes rotation of the heater tube such that the heater tube successively receives hygienic wipes from the roller assembly, the clamping rod being operative to alternately clamp and unclamp successive ones of the hygienic wipe from the heater tube during activation of the heater motor, the hygienic wipes steamer being configured such that a portion of liquid flowing into the heater tube from the liquid container is transformed into steam upon entry of the liquid into the heater tube, the steam passing through the steam holes and warming the hygienic wipe;

an ejector assembly disposed within the housing assembly and including:

an ejector motor;

a drive screw engaged to the ejector motor; and an ejector hook threadably engaged to the drive screw;

wherein the ejector assembly is configured such that activation of the ejector motor causes rotational motion of the drive screw effectuating axial motion of the ejector hook such that the hygienic wipe is removed from the heater tube and ejected out of the housing assembly after warming of the hygienic wipe.

18. The hygienic wipes steamer of claim 17 wherein the housing assembly is fabricated from a plastic material.

19. The hygienic wipes steamer of claim 17 wherein the liquid container is formed from plastic having an anti-microbial additive included therein.

20. The hygienic wipes steamer of claim 17 wherein the heating element is an electrically powered heating element.

21. The hygienic wipes steamer of claim 17 wherein the liquid within the liquid container is water.

22. The hygienic wipes steamer of claim 17 further comprising a pump unit fluidly connected between the liquid container and the heater assembly and being operative to pump fluid therebetween.

23. The hygienic wipes steamer of claim 17 wherein the roller assembly includes a pinch roller engageable to at least one feed roller for capturing the material therebetween, the feed roller being driven by the roller motor and cooperating with the pinch roller to draw the material therethrough.

* * * * *